US008438665B2

(12) United States Patent
Roemer et al.

(10) Patent No.: US 8,438,665 B2
(45) Date of Patent: May 14, 2013

(54) HOODED GARMENT WITH ADJUSTABLE HOOD SIDE PORTIONS AND METHOD OF ADJUSTING THE SAME

(75) Inventors: Colin Roemer, Apple Valley, MN (US); Peter Reichel, Nelson, NH (US)

(73) Assignee: Gander Mountain Company, St. Paul, MN (US)

( * ) Notice: Subject to any disclaimer, the term of this patent is extended or adjusted under 35 U.S.C. 154(b) by 2 days.

(21) Appl. No.: 13/195,571

(22) Filed: Aug. 1, 2011

(65) Prior Publication Data

US 2013/0031695 A1 Feb. 7, 2013

(51) Int. Cl.
*A41D 3/08* (2006.01)

(52) U.S. Cl.
USPC ..... 2/84

(58) Field of Classification Search ..... 2/209.11, 2/209.12, 209.13, 175.6, 175.7, 195.4, 94, 2/202, 10
See application file for complete search history.

(56) References Cited

U.S. PATENT DOCUMENTS

| | | | | |
|---|---|---|---|---|
| 2,241,694 | A | 5/1941 | Astrove | |
| 2,547,931 | A | 4/1951 | De Graza | |
| 2,897,510 | A | 8/1959 | Forbes-Robinson | |
| 3,518,701 | A | 7/1970 | Fekete | |
| 5,007,115 | A * | 4/1991 | Denbow et al. | 2/208 |
| 5,153,945 | A | 10/1992 | Kobayashi et al. | |
| 5,351,343 | A | 10/1994 | Harbison | |
| 5,664,259 | A | 9/1997 | Budd | |
| 5,694,647 | A | 12/1997 | Crickmore | |
| 5,694,648 | A | 12/1997 | Nucifora | |
| 5,790,986 | A | 8/1998 | Hall | |
| 5,822,800 | A * | 10/1998 | Anderson | 2/202 |
| 5,832,538 | A | 11/1998 | Williams | |
| D404,186 | S | 1/1999 | Bellon | |
| 5,881,389 | A | 3/1999 | Fruge | |
| 5,950,241 | A | 9/1999 | Gomez | |
| 5,960,478 | A * | 10/1999 | Sivret et al. | 2/202 |
| 6,370,692 | B1 | 4/2002 | Duyn et al. | |
| 6,374,418 | B1 * | 4/2002 | Rindle | 2/202 |
| 6,463,592 | B1 | 10/2002 | Brooks | |
| 6,654,963 | B2 | 12/2003 | Fayle et al. | |
| 6,966,072 | B1 | 11/2005 | Kobayashi | |
| 7,380,286 | B1 | 6/2008 | Bryant, Sr. | |
| 7,467,422 | B2 * | 12/2008 | Bugarin | 2/202 |
| D625,081 | S | 10/2010 | Oates | |
| 2005/0241045 | A1 | 11/2005 | Tolton | |

FOREIGN PATENT DOCUMENTS

| | | | |
|---|---|---|---|
| GB | 166432 | A | 7/1921 |
| JP | 2000-160412 | A | 6/2000 |
| SU | 1660680 | A1 | 7/1991 |

* cited by examiner

*Primary Examiner* — Tejash Patel
(74) *Attorney, Agent, or Firm* — Thompson Coburn LLP; Clyde L. Smith

(57) ABSTRACT

A garment includes a hood that can be adjusted by its wearer. The hood has opposite side portions and a face opening. The wearer can use the hood's drawstring to scrunch the face opening around the wearer's face with the side portions of the hood covering the wearer's ears. The wearer can also adjust the hood of the garment by folding the side portions of the hood back over a portion of the remainder of the hood in a manner such that the wearer's ears are exposed.

14 Claims, 4 Drawing Sheets

HOODED GARMENT WITH ADJUSTABLE HOOD SIDE PORTIONS AND METHOD OF ADJUSTING THE SAME

CROSS-REFERENCE TO RELATED APPLICATIONS

Not Applicable.

STATEMENT REGARDING FEDERALLY SPONSORED RESEARCH OR DEVELOPMENT

Not Applicable.

APPENDIX

Not Applicable

BACKGROUND OF THE INVENTION

1. Field of the Invention

This invention pertains to outerwear garments. More particularly, the present invention pertains to a hooded garment comprising a hood having adjustable side portions that allow a wearer to selectively expose and alternatively cover his or her ears while the remainder of the hood remains in place on his or her head.

2. General Background

Garments such as raincoats, jackets, coats, and vests often include attached hoods for shielding the wearer's head from the elements. In some cases, the hood portion can be removed from the remainder of the garment and in other cases the hood is permanently attached to the torso portion of the garment. The hoods themselves often include a drawstring for scrunching the face opening of the hood tightly around the wearer's face. Additionally, hoods are often wind and waterproof so as to shield most of the wearer's head from precipitation and wind.

SUMMARY OF THE INVENTION

A garment in accordance with the present invention comprises a hood that has side portions that can selectively be extended and alternatively retracted while the remainder of the hood can be utilized in a normal manner. This allows the wearer's ears to be exposed while wearing the hood and prevents the obstruction of the wearer's peripheral view by the hood. Hunters, especially bow hunters, may find this particularly useful in situations where protection from the elements is desired but obstructed senses are not. When greater protection from the elements is favored, the side portions can be extended to cover the wearer's ears.

In one aspect of the invention, a garment is configured to be worn by a wearer and comprises a torso portion and a hood. The torso portion has a neck opening that is adapted and configured to encircle the wearer's neck. The hood has a top portion, a rear portion, and opposite side portions. The top portion of the hood is adapted and configured to at least partially cover the top surface of the wearer's head. The rear portion is attached to the top portion and to the neck opening of the torso portion of the garment. The side portions are attached to the rear portion and the top portion of the hood. Each side portion has a lower margin that is releaseably attachable to the neck opening in a manner allowing the side portion to be adjustable between retracted and extended configurations. Each side portion is attached to the neck portion and is adapted to cover one of the wearer's ears when the side portion is in its extended configuration. Each side portion is detached from the neck portion and folded upward and rearward when the side portion is in its retracted configuration in manner such that the wearer's respective ear can be exposed while the top portion of the hood covers the top surface of the wearer's head and remains attached to the torso portion of the garment via the rear portion of the hood.

In another aspect of the invention, a garment configured to be worn by a wearer comprises a torso portion and a hood. The torso portion has a neck opening that is adapted and configured to encircle the wearer's neck. The neck opening comprises a neck shroud that is configured and adapted to selectively encircle the wearer's neck and lower face. The hood has a top portion, a rear portion, and opposite side portions. The top portion of the hood is adapted and configured to at least partially cover the top surface of the wearer's head. The rear portion is attached to the top portion and to the neck shroud. The side portions are attached to the rear portion and the top portion of the hood. Each side portion is adjustable between retracted and extended configurations. Each side portion is adapted to cover one of the wearer's ears when the side portion is in its extended configuration. Each side portion is folded when the side portion is in its retracted configuration in manner such that the wearer's respective ear can be exposed while the top portion of the hood covers the top surface of the wearer's head and remains attached to the torso portion of the garment via the rear portion of the hood. The neck shroud is adapted and configured to selectively encircle the wearer's neck and lower face when each of the side portions is in its retracted configuration and when each of the side portions is in its retracted configuration.

In yet another aspect of the invention, a method comprises wearing a garment and adjusting the hood of a garment. The garment comprises a torso portion and an attached hood. The hood has opposite side portions and a face opening. The method comprises using a pair of drawstring barrel locks and a drawstring to scrunch the face opening around the wearer's face with the side portions of the hood covering the wearer's ears. The method also comprises adjusting the hood of the garment by folding the side portions of the hood back over a portion of the remainder of the hood and connecting the drawstring barrel locks to each other in a manner such that the wearer's ears are exposed and such that the drawstring barrel locks secure the side portions in said folded configuration.

Further features and advantages of the present invention, as well as the operation of the invention, are described in detail below with reference to the accompanying drawings.

Figure 1:
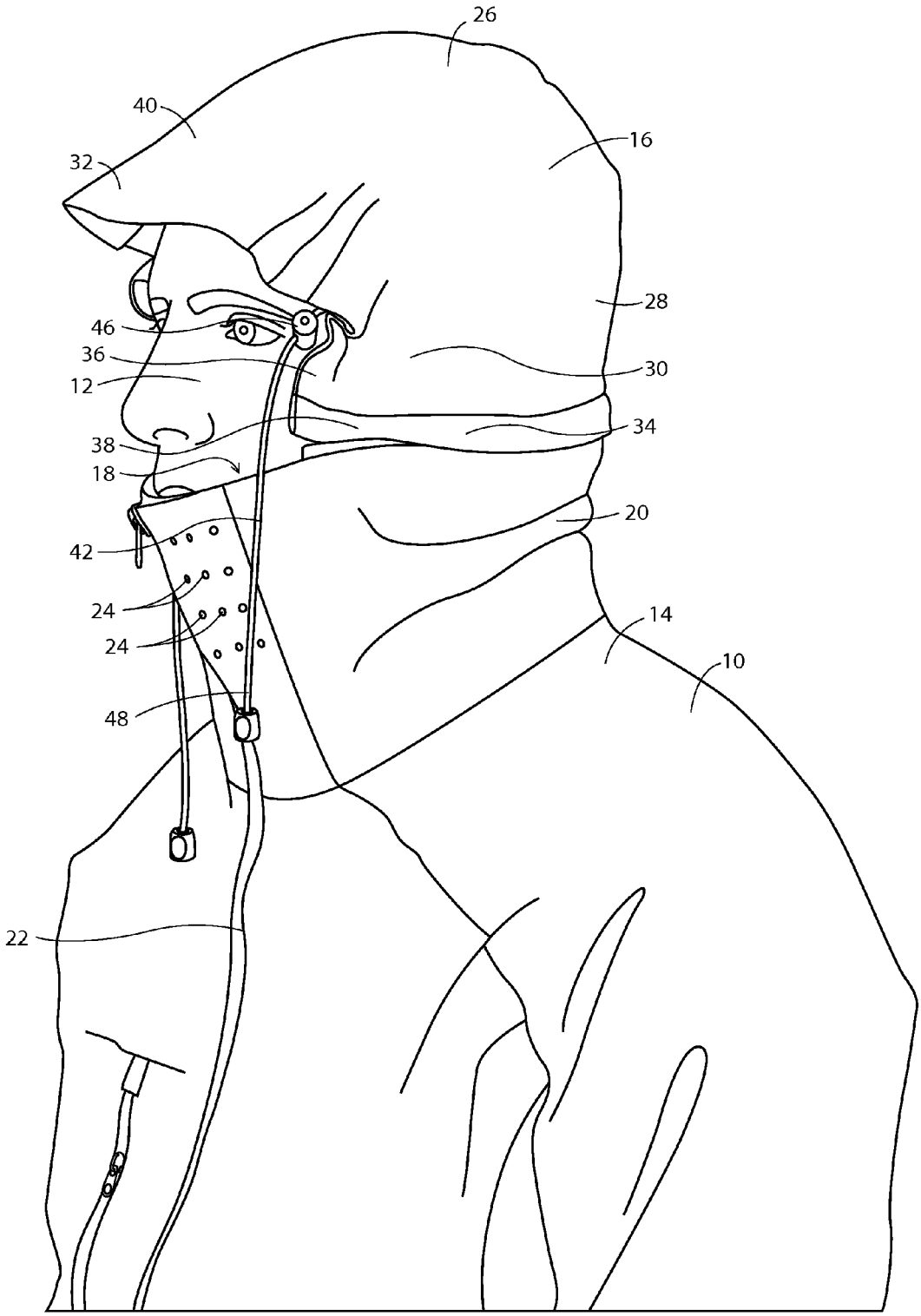
FIG. 1 depicts a perspective view of a preferred embodiment of garment in accordance with the invention being worn by a wearer, and is shown with the face opening of the garment's hood scrunched around the wearer's face and with the side portions of the hood covering the wearer's ears.

Reference numerals in the written specification and in the drawing figures indicate corresponding items.

DETAILED DESCRIPTION

Figure 2:
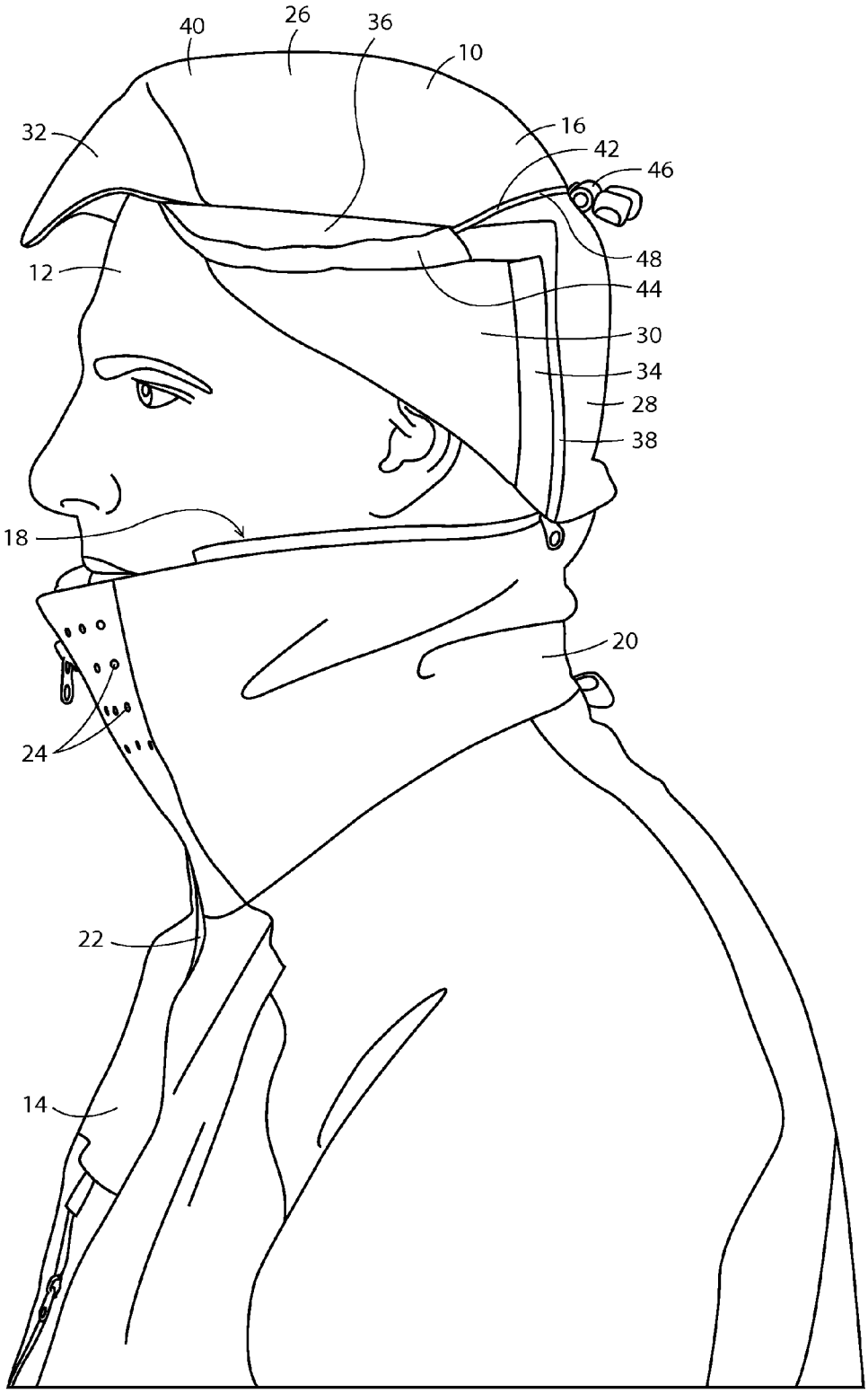
FIG. 2 depicts the side view of the garment and wearer shown in FIG. 1, and is shown with the side portions of the hood folded over a portion of the remainder of the hood and secured in place in a manner exposing the wearer's ears.
Figure 3:
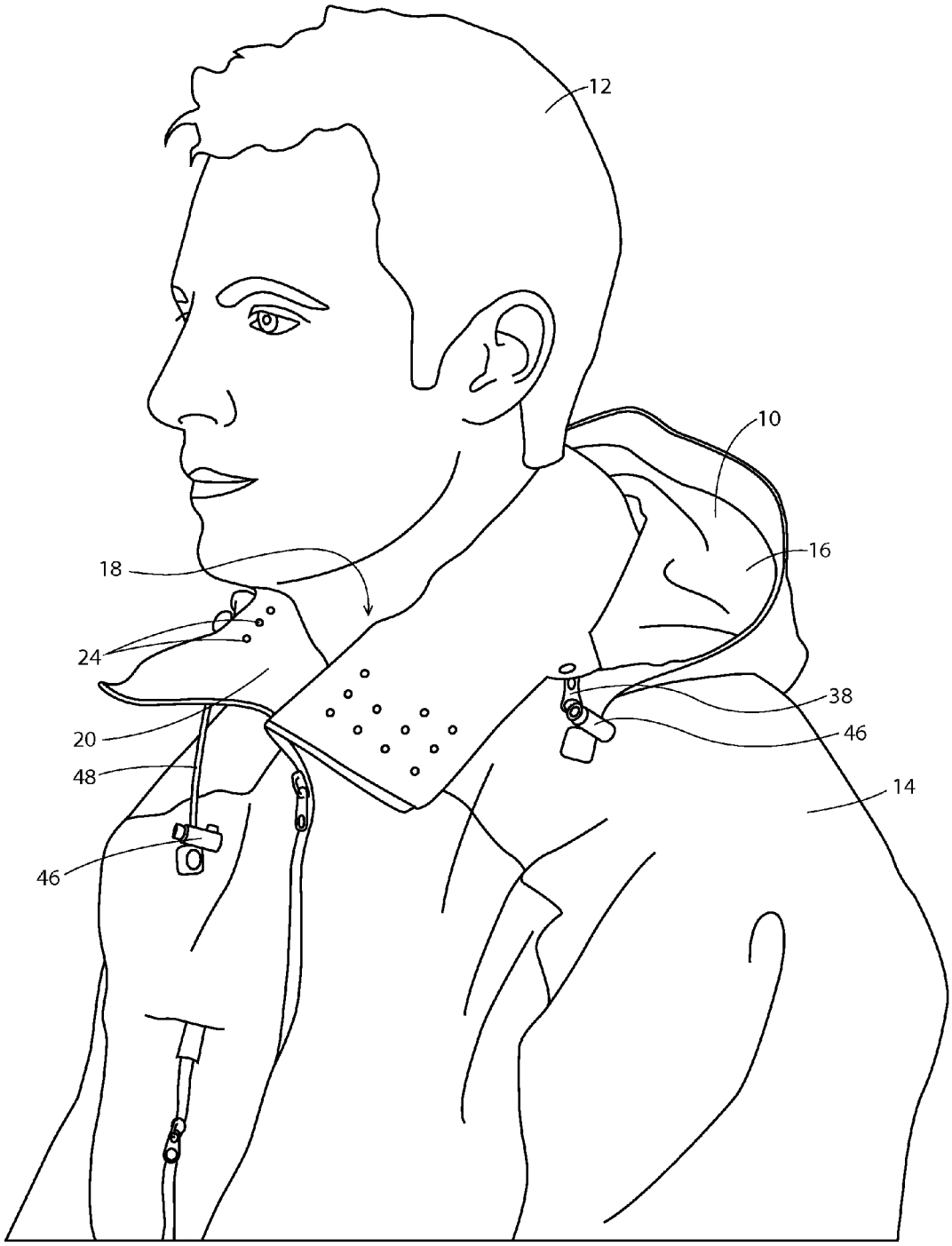
FIG. 3 depicts a perspective view of the garment and wearer shown in FIGS. 1 and 2, and is shown with the hood removed from the wearer's head and with the neck shroud of the garment folded down and away from the wearer's face.
Figure 4:
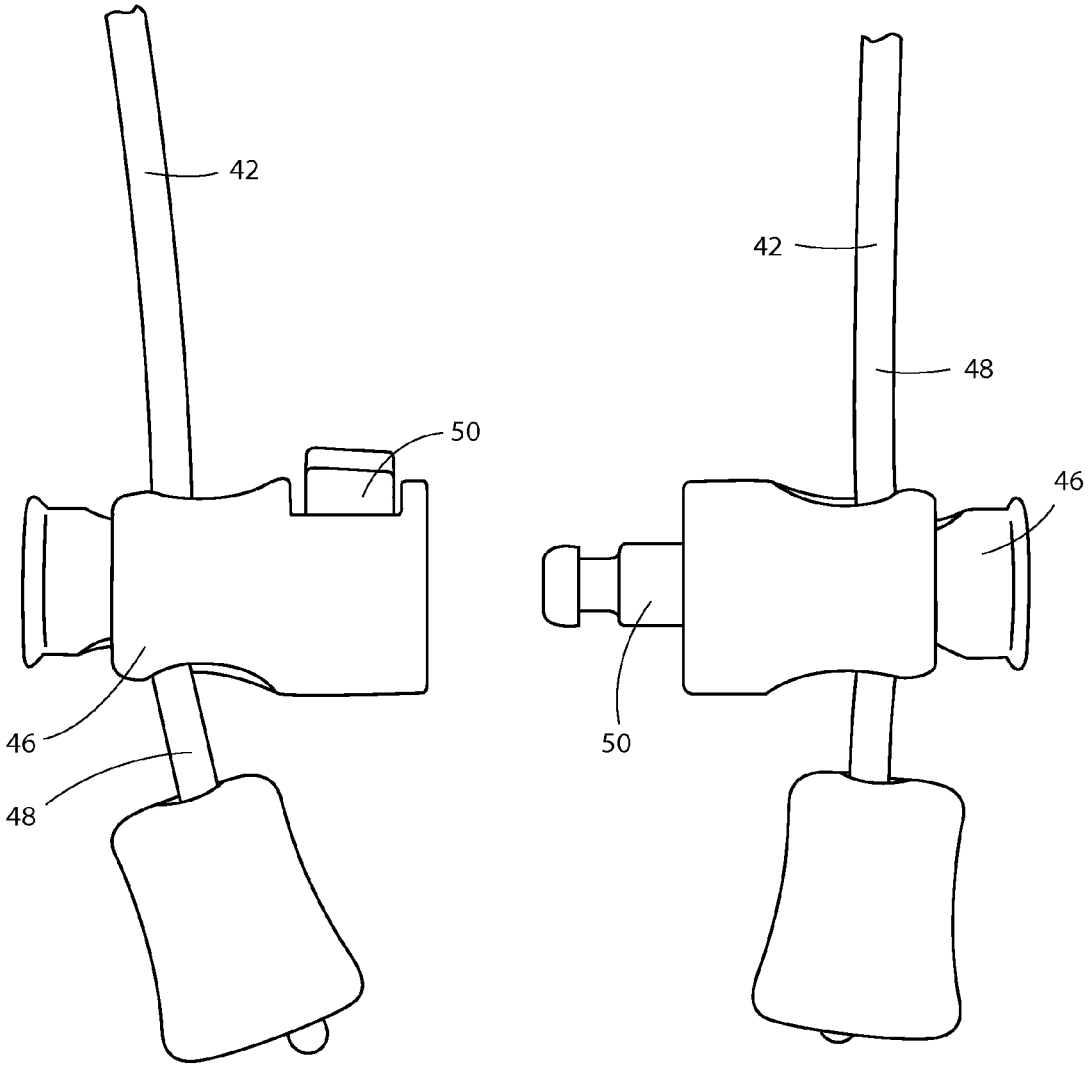
FIG. 4 depicts the pair of drawstring barrel locks attached to the opposite end margins of the drawstring of the garment shown in FIGS. 1-3.

An embodiment of a garment in accordance with the invention is shown in FIGS. 1-3. The garment 10 is shown being worn by a wearer 12 and comprises a torso portion 14 and a hood 16. The torso portion 14 comprises a neck opening 18 that includes a neck shroud 20. A zipper 22 is provided on the front of the torso portion 14 that can be partially unzipped in a manner such that the neck shroud 20 can be folded down like a collar (as depicted in FIG. 3). The neck shroud 20 is configured such that, when the zipper 22 is completely zipped, the neck shroud encircles the wearer's 12 neck and covers the wearer's lower face. A plurality of ventilation holes 24 are provided in the front of the neck shroud 20 to make it easier for the wearer 12 to breathe through his or her mouth when the neck shroud covers the wearer's lower face.

The hood 16 of the garment 10 comprises a top portion 26, a rear portion 28, opposite side portions 30, and a bill portion 32. The top portion 26 is adapted and configured to cover the top of the wearer's 12 head and is attached to the neck shroud 20 via the rear portion 28 of the hood 16 (which is configured and adapted to cover the back of the wearer's head). Each of the side portions 30 comprises a lower margin 34 and front margin 36 and is attached to the top portion 26 and the rear portion 28 of the hood 16. The lower margin 34 of each of the side portions 30 is selectively attachable to the neck shroud 20, preferably via a zipper 38. The bill portion 32 of the hood 16 extends from the front margin 40 of the top portion 26 of the hood and is configured and adapted to shield the wearer's 12 upper face from precipitation and sunlight when the hood is worn.

The hood 16 also comprises a drawstring 42, a drawstring channel 44, and a pair of drawstring barrel locks 46. The drawstring channel 44 extends along the front margin 40 of the top portion 26 of the hood 16 and along the front margin 36 of each of the side portions 30 of the hood. The drawstring 42 extends through the drawstring channel and has a pair of opposite end margins 48. One of the end margins 48 of the drawstring 42 extends out of the drawstring channel 44 at a location on the front margin 36 and lower margin 34 of one of the side portions 30 of the hood 16. The other of the end margins 48 of the drawstring 42 extends out of the drawstring channel 44 at a location on the front margin 36 and lower margin 34 of the other of the side portions 30 of the hood 16. The drawstring barrel locks 46 are attached to and along the end margins 48 of the drawstring 42. Like typical drawstring barrel locks, the drawstring barrel locks 46 of the hood 16 can slideably move along the end margins 48 of the drawstring 42 when squeezed and lock in place when released, and are too large to pass into the drawstring channel 44. The drawstring barrel locks 46 also comprise connectors 50 that are configured to releaseably connect the drawstring barrel locks to each other.

In use, the hood 16 of the garment 10 can be adjusted to suit the wearer's preferences. During heavy rainfall or in bitter cold or extreme winds, the side portions 30 of the hood 16 can be placed in their extended configuration by zipping the lower margin 34 of each side portion to the neck shroud 20 of the neck opening 18 via the zippers 38 provided on the hood (as shown in FIG. 1). In this configuration, the side portions 30 of the hood 16 cover the wearer's 12 ears. Optionally, the wearer 12 can also completely zip up the zipper 22 of the torso portion 14 of the garment 10 in manner such that the neck shroud 20 encircles the wearer's neck and covers the wearer's lower face. Still further, if desired, the wearer 12 can use the drawstring 42 to scrunch the face opening (as shown in FIG. 1), which is bound by the front edges of the top portion 26 and each of the side portions 30 of the hood 16 and by the top edge of the front of the neck shroud 20. To do this, the wearer squeezes the drawstring barrel locks 46 and slides them along the drawstring 42 in a manner increasing the length of the end margins 48 of the drawstring (thereby scrunching the drawstring channel 44). When the wearer 12 desires greater peripheral vision and hearing, the wearer can simply shorten the end margins 48 of the drawstring 42 in a similar, but reverse, manner and then retract the side portions 30 of the hood 16. To retract the side portions 30 of the hood 16, the wearer 12 unzips the zippers 38 located on the lower margin 34 of the side portions and then folds the side portions rearward and upward (as shown in FIG. 2) against portions of the remainder of the hood. To secure the side portions 30 of the hood 16 in their retracted configurations, the wearer 12 can snap the connectors 50 of the drawstring barrel locks 46 to each other behind and/or above his or her head in a manner such that the drawstring 42 prevents the side portions 30 from flipping back down and forward. This also serves as a means for preventing the end margins 48 of the drawstring 42 from flopping around against the wearer's 12 head. When the side portions 30 of the hood 16 in their retracted configuration, the wearer 12 is still able to utilize the neck shroud 20 to cover his or her lower face (if he or she desires to do so). It should also be appreciated that, when desired, the wearer 12 can remove the hood 16 from his or her head and allow it to drape against his or her back (as shown in FIG. 3).

In view of the foregoing, it should be appreciated that the invention achieves the several advantages over the prior art.

As various modifications could be made in the constructions and methods herein described and illustrated without departing from the scope of the invention, it is intended that all matter contained in the foregoing description or shown in the accompanying drawings shall be interpreted as illustrative rather than limiting. For example, the embodiment of the invention described above is preferably formed out of waterproof material, but other embodiments need not be waterproof. Additionally, the embodiment of the invention described above uses zippers to releasably attach the lower margins of the side portions of the hood to the neck shroud, but alternative attachment devices such as Velcro™ could be used. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, the use of identifiers such as first, second, and third should not be construed in a manner imposing any relative position or time sequence between limitations. Still further, the order in which the steps of any method claim that follows are presented should not be construed in a manner limiting the order in which such steps must be performed unless such order is necessarily required.

What is claimed is:

1. A garment configured to be worn by a wearer, the garment comprising:

a torso portion, the torso portion having a neck opening that is adapted and configured to encircle the wearer's neck;

a hood, the hood having a top portion, a rear portion, and opposite side portions, the top portion of the hood being adapted and configured to at least partially cover the top surface of the wearer's head, the rear portion being attached to the top portion and to the neck opening of the torso portion of the garment, the side portions being attached to the rear portion and the top portion of the hood, each side portion having a lower margin that is releaseably attachable to the neck opening in a manner allowing the side portion to be adjustable between retracted and extended configurations, each side portion being attached to the neck opening and adapted to cover one of the wearer's ears when the side portion is in its extended configuration, each side portion being detached from the neck opening and folded upward and rearward when the side portion is in its retracted configuration in manner such that the wearer's respective ear can be exposed while the top portion of the hood covers the top surface of the wearer's head and remains attached to the torso portion of the garment via the rear portion of the hood.

2. A garment in accordance with claim 1 wherein the rear portion of the hood is non-detachable from the neck opening of the torso portion of the garment.

3. A garment in accordance with claim 1 wherein the neck opening of the torso portion of the garment comprises a neck shroud, the neck shroud is configured and adapted to selectively encircle the wearer's neck and lower face.

4. A garment in accordance with claim 1 wherein the hood further comprises a drawstring and a drawstring channel, the top portion and each of the side portions of the hood each comprise a forward margin, the drawstring channel extends along the front margin of each of the side portions and the top portion of the hood, the drawstring extends through the drawstring channel and has a pair of opposite end margins, one of the opposite end margins of the drawstring extends out of the drawstring channel at a location on the front margin and lower margin of one of the side portions of the hood, and the other of the opposite end margins of the drawstring extends out of the drawstring channel at a location on the front margin and lower margin of the other of the side portions of the hood.

5. A garment in accordance with claim 4 wherein the hood comprises a bill portion that extends from the front margin of the top portion of the hood and that is configured and adapted to shield the wearer's upper face from precipitation and sunlight.

6. A garment in accordance with claim 4 wherein the hood further comprises a pair of drawstring barrel locks, each drawstring barrel lock is selectively slideable and lockable along a respective one of the opposite end margins of the drawstring and is too large to pass into the drawstring channel, the drawstring barrel locks are configured and adapted to selectively scrunch the drawstring channel, thereby selectively scrunching the front margin of each of the top portion and side portions of the hood, and the drawstring barrel locks are also adapted and configured to selectively lock and unlock to and from each other such that the drawstring barrel locks can be locked together over the top portion of the hood in manner such that the drawstring secures each of the side portions in its retracted configuration.

7. A garment configured to be worn by a wearer, the garment comprising:

a torso portion, the torso portion having a neck opening that is adapted and configured to encircle the wearer's neck, the neck opening comprising a neck shroud that is configured and adapted to selectively encircle the wearer's neck and lower face;

a hood, the hood having a top portion, a rear portion, and opposite side portions, the top portion of the hood being adapted and configured to at least partially cover the top surface of the wearer's head, the rear portion being attached to the top portion and to the neck shroud, the side portions being attached to the rear portion and the top portion of the hood, each side portion being adjustable between retracted and extended configurations, each side portion being adapted to cover one of the wearer's ears when the side portion is in its extended configuration, each side portion being folded when the side portion is in its retracted configuration in manner such that the wearer's respective ear can be exposed while the top portion of the hood covers the top surface of the wearer's head and remains attached to the torso portion of the garment via the rear portion of the hood, the neck shroud being adapted and configured to selectively encircle the wearer's neck and lower face when each of the side portions is in its retracted configuration and when each of the side portions is in its retracted configuration.

8. A garment in accordance with claim 7 wherein the rear portion of the hood is non-detachable from the neck shroud.

9. A garment in accordance with claim 7 wherein each of the side portions of the hood are releaseably attachable to the neck shroud when the side portion is in its extended configuration.

10. A garment in accordance with claim 7 wherein the hood further comprises a drawstring and a drawstring channel, the top portion and each of the side portions of the hood each comprise a forward margin, the drawstring channel extends along the front margin of each of the side portions and the top portion of the hood, the drawstring extends through the drawstring channel and has a pair of opposite end margins, one of the opposite end margins of the drawstring extends out of the drawstring channel at a location on the front margin and lower margin of one of the side portions of the hood, and the other of the opposite end margins of the drawstring extends out of the drawstring channel at a location on the front margin and lower margin of the other of the side portions of the hood.

11. A garment in accordance with claim 10 wherein the hood comprises a bill portion that extends from the front margin of the top portion of the hood and that is configured and adapted to shield the wearer's upper face from precipitation and sunlight.

12. A garment in accordance with claim 10 wherein the hood further comprises a pair of drawstring barrel locks, each drawstring barrel lock is selectively slideable and lockable along a respective one of the opposite end margins of the drawstring and is too large to pass into the drawstring channel, the drawstring barrel locks are configured and adapted to selectively scrunch the drawstring channel, thereby selectively scrunching the front margin of each of the top portion and side portions of the hood, and the drawstring barrel locks are also adapted and configured to selectively lock and unlock to and from each other such that the drawstring barrel locks can be locked together over the top portion of the hood in manner such that the drawstring secures each of the side portions in its retracted configuration.

13. A method of adjusting a garment, the garment being configured to be worn by a wearer, the method comprises:

wearing a garment, the garment comprising a torso portion and an attached hood, the torso portion of the garment comprising a neck opening and the hood having opposite side portions and a face opening;

using a pair of drawstring barrel locks and a drawstring to scrunch the face opening around the wearer's face with the side portions of the hood covering the wearer's ears;

adjusting the hood of the garment by folding the side portions of the hood back over a portion of the remainder of the hood and connecting the drawstring barrel locks to each other in a manner such that the wearer's ears are exposed and such that the drawstring barrel locks secure the side portions in said folded configurations, the adjusting of the hood comprising detaching a portion of the side portions from the neck opening prior to folding the side portions of the hood back over the portion of the remainder of the hood.

14. A method in accordance with claim 13 wherein the neck opening of torso portion of the garment includes a neck shroud, and the method comprises covering the wearer's lower face with the neck shroud while the side portions of the hood are folded back over a portion of the remainder of the hood.

* * * * *